US009007201B2

(12) United States Patent
Piccolo, III et al.

(10) Patent No.: US 9,007,201 B2
(45) Date of Patent: Apr. 14, 2015

(54) METHOD FOR SELF-TESTING NOTIFICATION APPLIANCES IN ALARM SYSTEMS

(71) Applicant: SimplexGrinnell LP, Westminster, MA (US)

(72) Inventors: Joseph Piccolo, III, Fitzwilliam, NH (US); David Dahlstrom, Hubbardston, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 155 days.

(21) Appl. No.: 13/896,906

(22) Filed: May 17, 2013

(65) Prior Publication Data

US 2014/0340215 A1 Nov. 20, 2014

(51) Int. Cl.

*G08B 29/00* (2006.01)
*G08B 29/12* (2006.01)
*H04R 29/00* (2006.01)

(52) U.S. Cl.

CPC ..... *G08B 29/12* (2013.01); *G08B 29/126* (2013.01); *H04R 29/007* (2013.01)

(58) Field of Classification Search

CPC ..... G08B 29/126; G08B 29/12; H04R 29/007
USPC ..... 340/514, 515, 516, 627, 628
See application file for complete search history.

(56) References Cited

U.S. PATENT DOCUMENTS 6,591,198 B1 * 7/2003 Pratt ..... 702/35
7,956,764 B2 * 6/2011 Morris ..... 340/692
8,023,661 B2 * 9/2011 Brooks et al. ..... 381/56
8,401,823 B2 3/2013 Klippel
2005/0063552 A1 * 3/2005 Shuttleworth et al. ..... 381/57
2010/0315224 A1 * 12/2010 Orsini et al. ..... 340/516
2012/0286946 A1 * 11/2012 Karl et al. ..... 340/516
2013/0076506 A1 * 3/2013 Smith et al. ..... 340/514
2014/0241533 A1 * 8/2014 Gerrish et al. ..... 381/57

FOREIGN PATENT DOCUMENTS

DE 102009033614 A1 1/2011

OTHER PUBLICATIONS

International Search Report and Written Opinion mailed Oct. 16, 2014 issued in corresponding PCT/US2014/038033, filed May 15, 2014 (seven (7) pages).

* cited by examiner

*Primary Examiner* — Brian Zimmerman
*Assistant Examiner* — Sara Samson
(74) *Attorney, Agent, or Firm* — Kacvinsky Daisak Bluni PLLC

(57) ABSTRACT

A method for self-testing notification appliances in an alarm system, including the steps of measuring ambient noise at a notification appliance, comparing the measured ambient noise to a threshold ambient noise level, and performing a self-test of the notification appliance if the measured ambient noise does not exceed the threshold ambient noise level. The method may further include the step of recording a fail result for the notification appliance if the measured ambient noise exceeds the threshold ambient noise level. Performing the self-test of the notification appliance may include the steps of activating a notification feature of the notification appliance, measuring output of the notification feature, comparing the measured output to a predefined value, recording a pass result for the notification appliance if the measured output exceeds the predefined value, and recording a fail result for the notification appliance if the measured output does not exceed the predefined value.

9 Claims, 5 Drawing Sheets

METHOD FOR SELF-TESTING NOTIFICATION APPLIANCES IN ALARM SYSTEMS

FIELD OF THE DISCLOSURE

The disclosure relates generally to the field of alarm systems, and more particularly to an improved method for self-testing notification appliances in alarm systems.

BACKGROUND OF THE DISCLOSURE

Alarm systems, such as fire alarm systems, typically include a plurality of notification appliances (e.g. horn/strobe units), that are installed throughout a monitored building and that are configured to be activated upon the detection of an alarm condition, such as the presence of fire or smoke. Occupants of the building may thereby be notified of potentially hazardous conditions and may evacuate the building or take other action before being harmed. It is therefore critically important that the notification appliances of alarm systems always be in good working order.

Governmental entities may require that notification appliances, and particularly those of fire alarm systems, be tested periodically to verify that such appliances are operating properly. Such testing is typically performed by one or more designated inspectors who walk through an entire monitored building and physically visit each notification appliance installed therein. The inspectors may activate each appliance for a predefined amount of time to verify functionality, and may make note of whether each appliance performed in a satisfactory manner. Particularly, an inspector may record a "pass" result for notification appliances that successfully activated their notification features (e.g. strobes, horns, etc.) and may record a "fail" result for notification appliances that failed to activate their notification features. Evaluating the functionality of notification appliances in this manner can be extremely burdensome, as it can be time-consuming and arduous to physically visit every notification appliance in a building. This is especially true for alarm systems that include a large number of notification appliances and/or that include notification appliances that are installed in parts of a building that are not readily accessible.

In order to alleviate the burden of notification appliance testing, so-called "self-test" technologies have been developed which enable notification appliances to automatically evaluate their own functionality. For example, a notification appliance that is equipped with self-test capability may include one or more sensors, such as a microphone, sound detector, camera, photo eye, light detector, etc., located adjacent the appliance's notification features (e.g. strobes, horns, sirens, etc.). Upon executing a self-test of such a notification appliance, such as may be initiated from a centrally located alarm panel or workstation within a monitored building, the notification appliance may activate its notification features for a predefined amount of time. While the notification features of the appliance are active, the sensors may measure the output generated thereby. If it is determined from the measurement that the notification features successfully generated output, a "pass" result may be automatically recorded by the appliance. Conversely, if it is determined that the notification features failed to generate output, a "fail" result may be automatically recorded by the appliance. The self-test feature thereby relieves inspectors from having to physically visit, manually test, and observe each appliance in an alarm system to effectuate a functional test.

One shortcoming associated with existing self-test technologies is that the sensors of a notification appliance that is being self-tested do not discriminate between output generated by the notification features of the notification appliance and ambient sound or light produced by other sources. Therefore, when the output of such notification features is measured during self-testing, a particularly strong source of ambient sound or light produced by a source other than the notification features could result in a so-called "false positive." That is, a notification appliance having a defective notification feature that would normally fail a self-test may measure ambient sound or light generated by a nearby device, and may mistakenly interpret such sound or light as output generated by its own notification features, thereby causing the notification appliance to erroneously record a "pass" result for the self-test. One example of such a situation would be a loud lunch bell ringing in the vicinity of a fire alarm horn that is being self-tested.

SUMMARY

In view of the foregoing, it would be advantageous to provide improved means for self-testing notification appliances in an alarm system wherein such means are able to discriminate between the output of the notification features of a notification appliance that is being tested and other, ambient sound or light.

An exemplary method in accordance with the present disclosure may include the steps measuring ambient noise at a notification appliance, comparing the measured ambient noise to a threshold ambient noise level, and performing a self-test of the notification appliance if the measured ambient noise does not exceed the threshold ambient noise level. The method may further include the step of recording a specially flagged fail result if the measured ambient noise exceeds the threshold ambient noise level. Performing the self-test of the notification appliance may include the steps of activating a notification feature of the notification appliance, measuring output of the notification feature, comparing the measured output to a predefined value, recording a pass result for the notification appliance if the measured output exceeds the predefined value, and recording a fail result for the notification appliance if the measured output does not exceed the predefined value.

DETAILED DESCRIPTION

Figure 1:
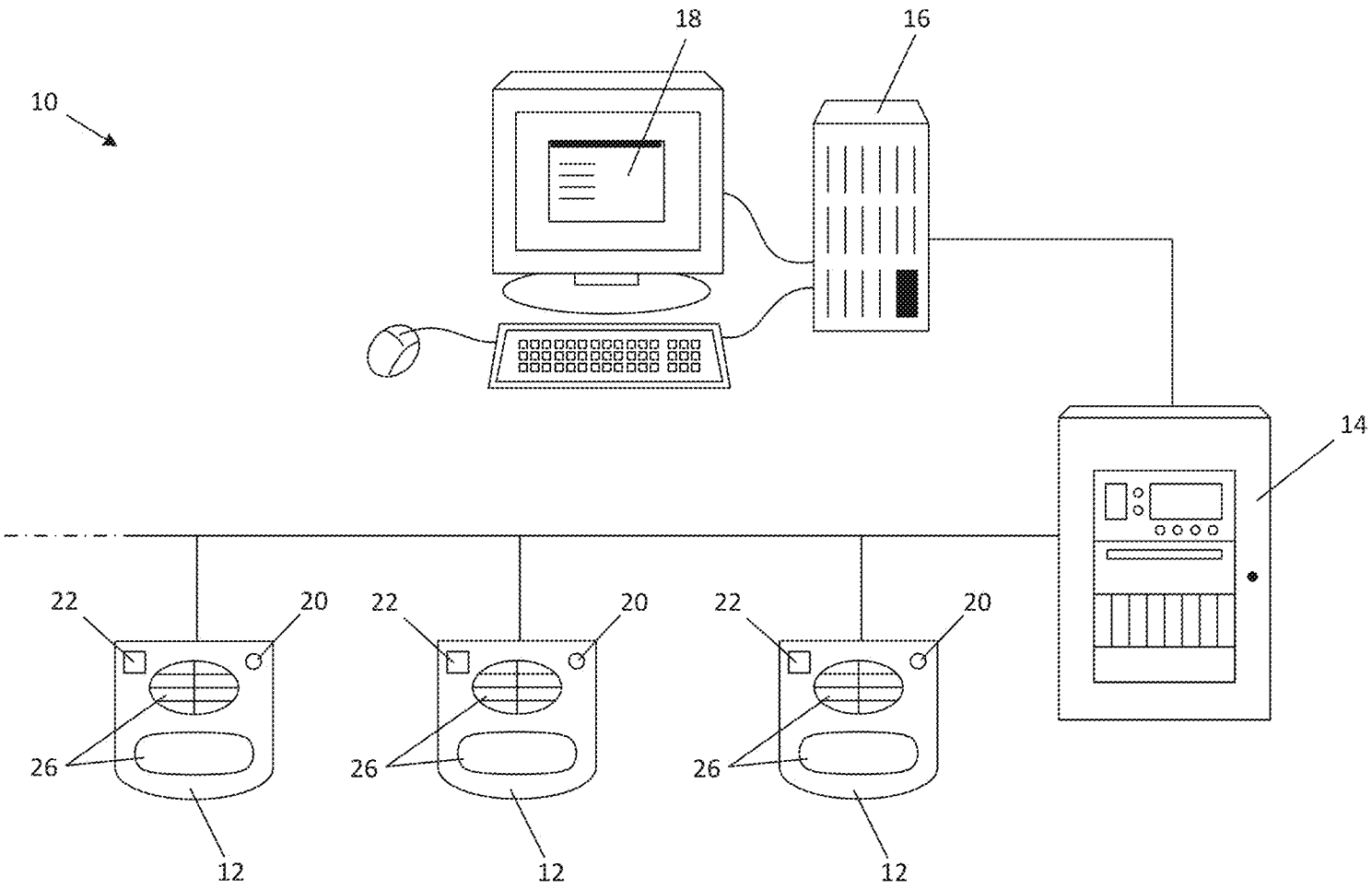
FIG. 1 is a schematic diagram illustrating an exemplary embodiment of an alarm system in accordance with the present disclosure.

A method for self-testing notification appliances in accordance with the present disclosure will now be described more fully hereinafter with reference to the accompanying drawings, in which preferred embodiments of the invention are shown. The disclosed methods, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the method described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g. a security breach) or a warning condition (e.g. an elevated temperature) in a building, structure, enclosure, or area. Many other applications are contemplated and may be implemented without departing from the scope of the present disclosure. All such applications are collectively referred to herein as "alarm systems."

Referring to FIG. 1, an exemplary alarm system 10 in accordance with the present disclosure is shown. The alarm system 10 may include a plurality of notification appliances 12 that may be installed throughout a monitored structure and connected to one or more alarm panels 14. Each notification appliance 12 may be associated with a unique address within the alarm system 10 for facilitating identification thereof by the alarm panel 14 and enabling selective routing of command/control signals from the alarm panel 14 to each notification appliance 12. The notification appliances 12 may be configured to provide notification of an alarm condition (e.g. fire and/or smoke) within the structure, such as may be detected by one or more initiating devices (not shown) in the alarm system 10. The notification appliances 12 shown in FIG. 1 are strobe/horn units, but it is contemplated that other varieties of notification appliances, such as sirens, bells, buzzers, etc., may additionally or alternatively be implemented in the alarm system 10 in a similar manner. For the sake of convenience and clarity, only three notification appliances 12 are shown, but it is to be understood that the alarm system 10 may include many additional notification appliances 12 without departing from the scope of the present disclosure.

The exemplary alarm system 10 may also include a workstation 16, such as a personal computer (PC) or server, which is operatively connected to the alarm panel 14. The workstation 16 may be loaded with one or more software applications that provide human operators of the system 10 with a user interface 18 for monitoring and controlling certain aspects of the alarm system 10. For example, the user interface 18 may allow an operator to observe the functional status of the notification appliances 12, and to activate, deactivate, test, inspect, or otherwise exert control over the notification appliances 12 as further described below. Alternatively, it is contemplated that the workstation 16 and user interface 18 may be entirely omitted from the alarm system 10, and that an operator may activate, deactivate, test, inspect, observe the functional status of, or otherwise exert control over the notification appliances 12 via the alarm panel 14.

Each of the notification appliances 12 may be equipped with one or more sensors 20 that are configured to measure the output of the notification features 26 (e.g. strobe and horn) of a respective notification appliance 12 as further described below. The sensors 20 may include any type of sensing or detecting devices or elements that are capable of measuring light and/or sound, including, but not limited to, microphones, sound detectors, cameras, photo eyes, light detectors, and the like. The sensors 20 may be mounted on the exteriors of the notification appliances 12, and/or may be disposed within the notification appliances 12.

It is contemplated that one or more of the notification appliances 12 may be configured for local, manual activation of a self-test function (described below). Such notification appliances 12 may be provided with a manually actuated input device 22, such as a switch or a button. The input devices 22 may be configured such that actuation of an input device 22 may cause a respective notification appliance 12 to perform a self-test as further described below. Alternatively, if a notification appliance 12 is configured for only remote activation of a self-test, such as may be initiated at the alarm panel 14 or at the workstation 16, the input device 22 may be omitted.

The input devices 22 shown in FIG. 1 may be magnetic switches that are actuated by waving a magnetic key 24 (shown in FIG. 5) in close proximity thereto. Such magnetic keys 24 may be made available to a designated system inspector or group of designated system inspectors. Limiting access to the input devices 22 in this manner is advantageous because it prevents unauthorized individuals from interfering with self-testing of the alarm system 10. However, it is contemplated that various other types of input devices 22 may additionally or alternatively be implemented without departing from the present disclosure. For example, it is contemplated that the input devices 22 may be simple buttons or switches that can be actuated by any individual.

Figure 2:
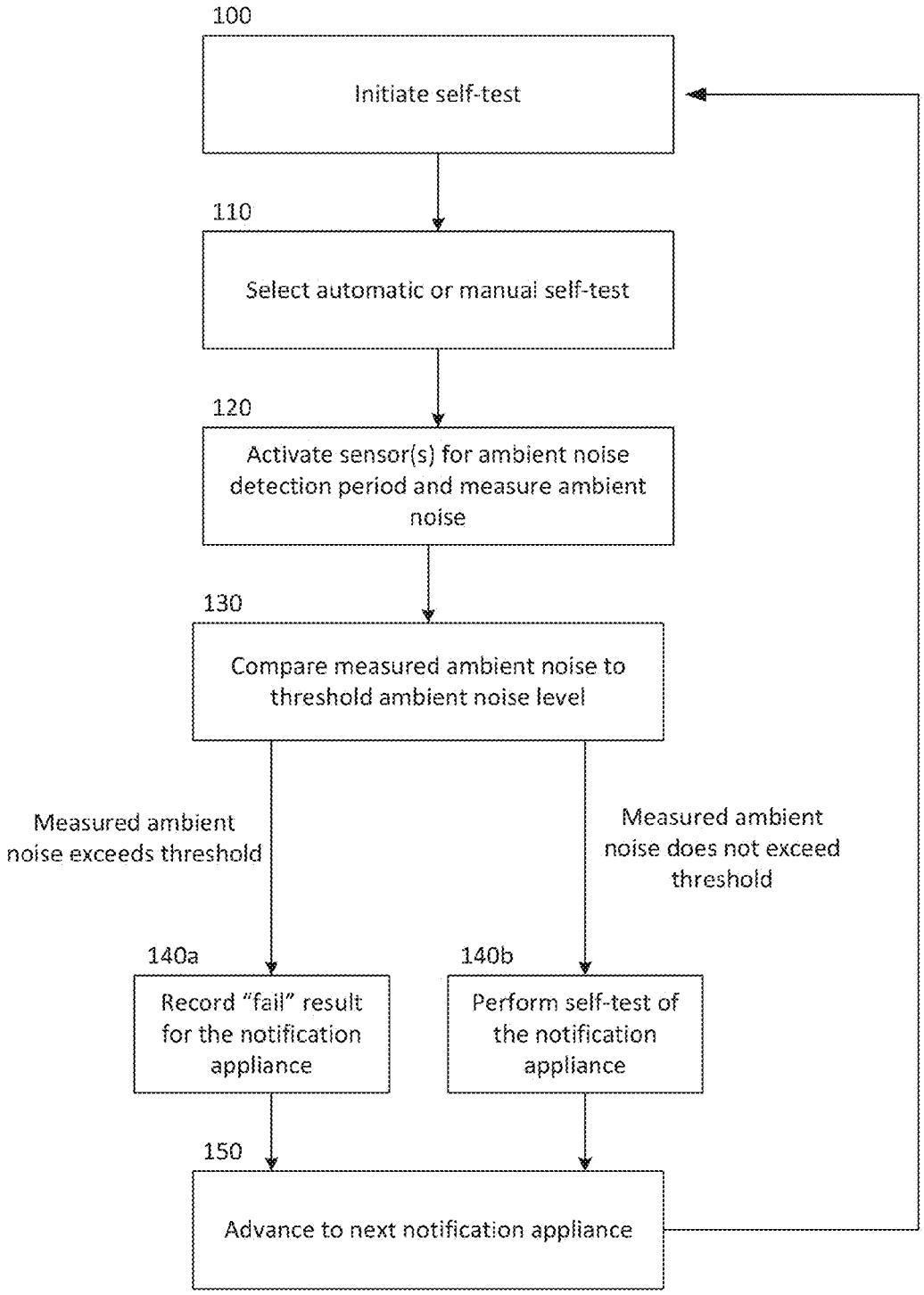
FIG. 2 is a flow diagram illustrating an exemplary embodiment of a method in accordance with the present disclosure.

Referring to FIG. 2, a flow diagram illustrating an exemplary method for self-testing of the notification appliances 12 of the alarm system 10 in accordance with the present disclosure is shown. The method will now be described in detail in conjunction with the schematic representations of the alarm system 10 shown in FIGS. 3-8.

Figure 3:
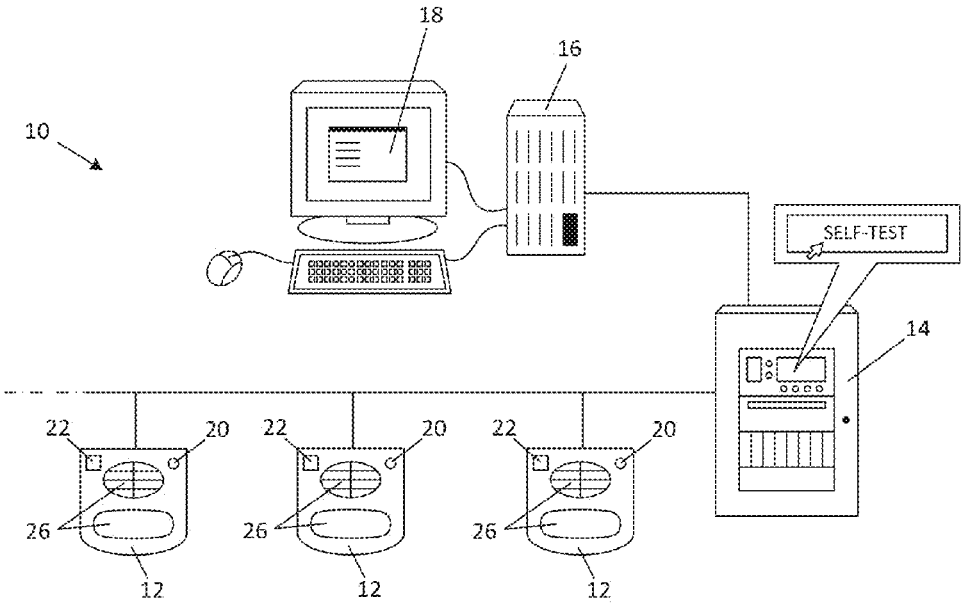
FIGS. 3-8 are a series of schematic diagrams illustrating the exemplary method shown in FIG. 2 being performed on the alarm system shown in FIG. 1.

At a first step 100 of the exemplary method, a technician or other designated party (hereinafter collectively referred to as "the technician") may initiate a self-test of the alarm system 10. This may be achieved by making an appropriate selection in the user interface 18 or at the alarm panel 14 using appropriately configured soft or hard input means, such as by selecting a "SELF-TEST" or similarly labeled option in a menu or sub-menu of the alarm panel 14 as shown in FIG. 3. The self-test function may be performed at any time after installation of the alarm system 10 in order to determine whether the notification appliances 12 of the alarm system 10 are in good working order and are able to produce sound and/or light in accordance with certain predefined standards as further described below.

Figure 4:
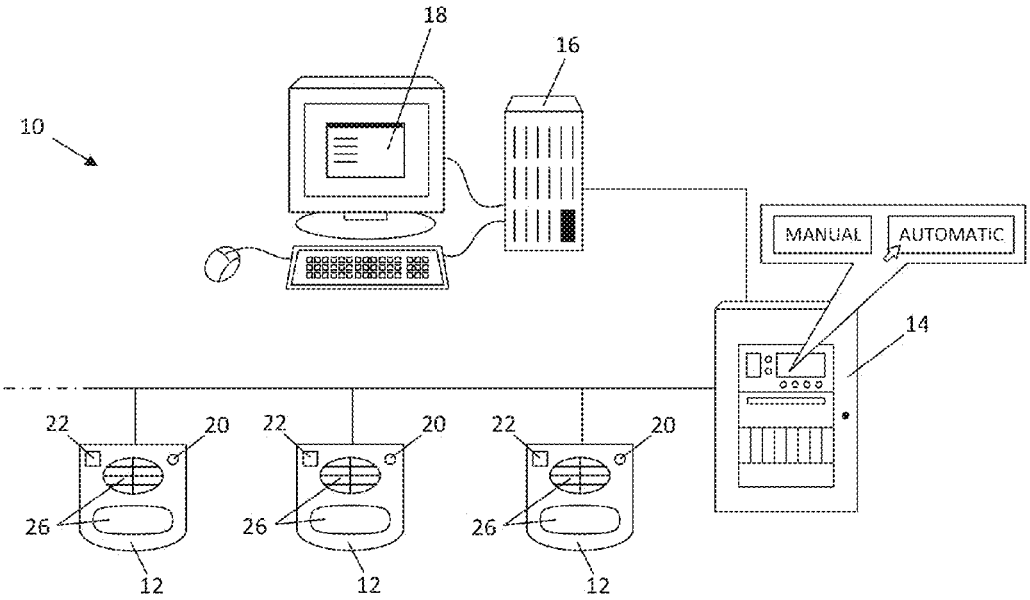

At step 110 of the exemplary method, the technician may be provided with an option to perform either "automatic self-testing" of the notification appliances 12, whereby the notification appliances 12 are automatically activated to effectuate the self-test function (as described below), or "manual self-testing" of the notification appliances 12, whereby the technician must physically visit and manually activate each notification appliance 12 to effectuate the self-test function (as described below). The technician may initiate either mode of self-testing by making an appropriate selection in the user interface 18 or at the alarm panel 14 using appropriately configured soft or hard input means, such as by selecting an "AUTOMATIC" or "MANUAL" option in a menu or sub-menu of the alarm panel 14 as shown in FIG. 4. Alternatively, if the alarm system 10 is configured only for automatic self-testing or only for manual self-testing, the technician may not be provided with any such option.

Figure 5:
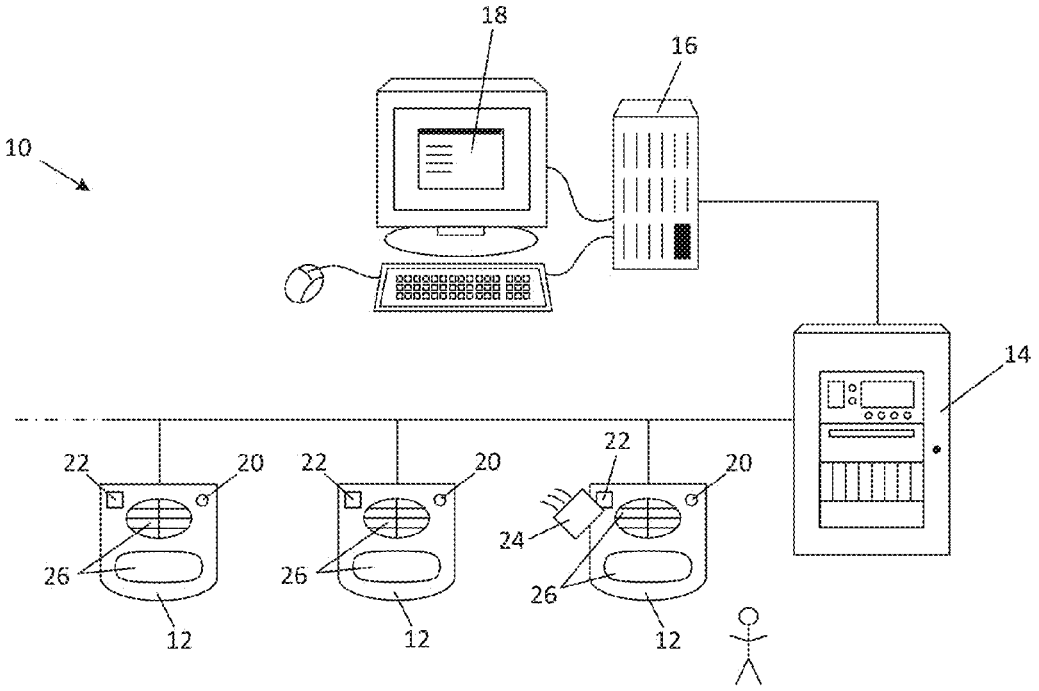

At step 120 of the exemplary method, if the technician selected automatic self-testing at step 110, or if the alarm system 10 is configured only for automatic self-testing, the sensor 20 of a first of the notification appliances 12 may be automatically activated for a predefined amount of time, hereinafter referred to as "the ambient noise detection period" (described below). Alternatively, if the technician selected manual self-testing at step 110, or if the alarm system 10 is configured only for manual self-testing, the technician may physically visit the first notification appliance 12 (e.g., the rightmost notification appliance in FIG. 5) and may manually actuate the appliance's input device 22. For example, the technician may wave a magnetic key 30 in close proximity to the input device 22 as shown in FIG. 5. Actuating the input device 22 thusly may cause the sensor 20 of the first notification appliance 12 to be activated for the ambient noise detection period.

During the ambient noise detection period, the activated sensor 20 of the first notification appliance 12 may measure any ambient sound or light (hereinafter collectively referred to as "ambient noise") that is detectable thereby, such as may be produced by sources of sound or light other than the notification features 26 of the notification appliance 12 (which are not activated). Such sources may include any type of electrical, mechanical, or electromechanical device that is capable of emitting sound or light, including, but not limited to, various bells, buzzers, sirens, horns, strobes, lamps, such as may be located in the vicinity of the notification appliance 12. Examples of such devices include a lunch bell in a school or telephones in an office. Other sources of ambient sound or light may include any natural or biological source of sound or light, such as transient direct or reflected sunlight, a screaming child, or a barking dog, for example.

The ambient noise detection period may be of any duration that is suitable for allowing the sensor 20 of a notification appliance 12 to accurately measure ambient noise. More preferably, the ambient noise detection period may be long enough to allow ambient noise of relatively short duration to subside prior to expiration of the ambient noise detection period. For example, it is contemplated that the ambient noise detection period may be between about 1 and 5 seconds. Of course, it will be appreciated that the ambient noise detection period may be made longer or shorter without departing from the scope of the present disclosure.

At step 130 of the exemplary method, the measured ambient noise may be compared against a predetermined "threshold ambient noise level." The threshold ambient noise level may represent an acceptable level of ambient noise that may be present during the performance of a self-test (described below) of the notification appliance 12 without affecting the result of the self-test. For example, it is contemplated that the threshold ambient noise level may be equal to a particular number of decibels (e.g., 100-130 dB) or candelas (e.g., 8-12 candelas) measured at the sensor 20 which, if measured during a self-test of the notification appliance 12, will not cause the self-test to register a false positive if the notification feature 26 of the notification appliance 12 is defective (i.e., would fail a self-test in the absence of the ambient sound or light). It will be understood that the threshold ambient noise level may be equal to a value that is well outside of the exemplary ranges set forth above without departing from the present disclosure. The comparison of the measured ambient noise to the threshold ambient noise level may be performed by an appropriately configured processor residing onboard the first notification appliance 12. Alternatively, the comparison may be performed by the alarm panel 14 or workstation 16.

Figure 6:
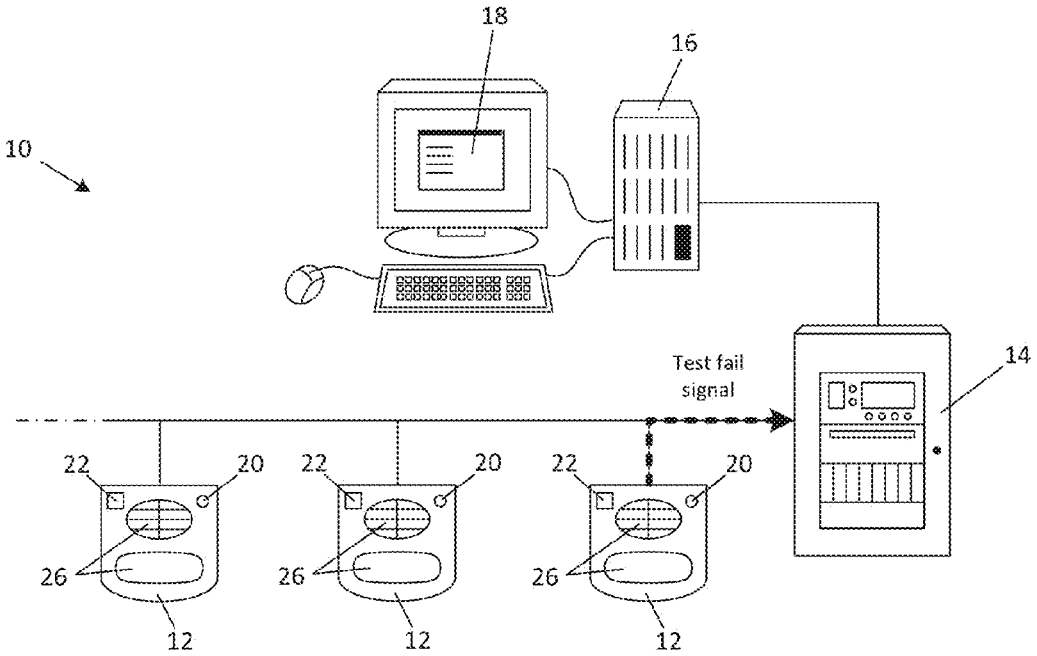

At step 140*a* of the exemplary method, if it was determined in step 130 that the measured ambient noise exceeded the threshold ambient noise level and did not subside (i.e. fall below the threshold ambient noise level) prior to expiration of the ambient noise detection period, the notification appliance 12 may automatically transmit a special "test fail signal" to the alarm panel 14 as indicated by the dashed arrow shown in FIG. 6. Upon receiving the test fail signal, the alarm panel 14 may record the unique address of the tested notification appliance 12, and may also record the date and time when the fail signal was received. The recorded test fail signal may provide notice to the technician or other interested parties that the notification appliance 12 requires further attention or retesting.

Figure 7:
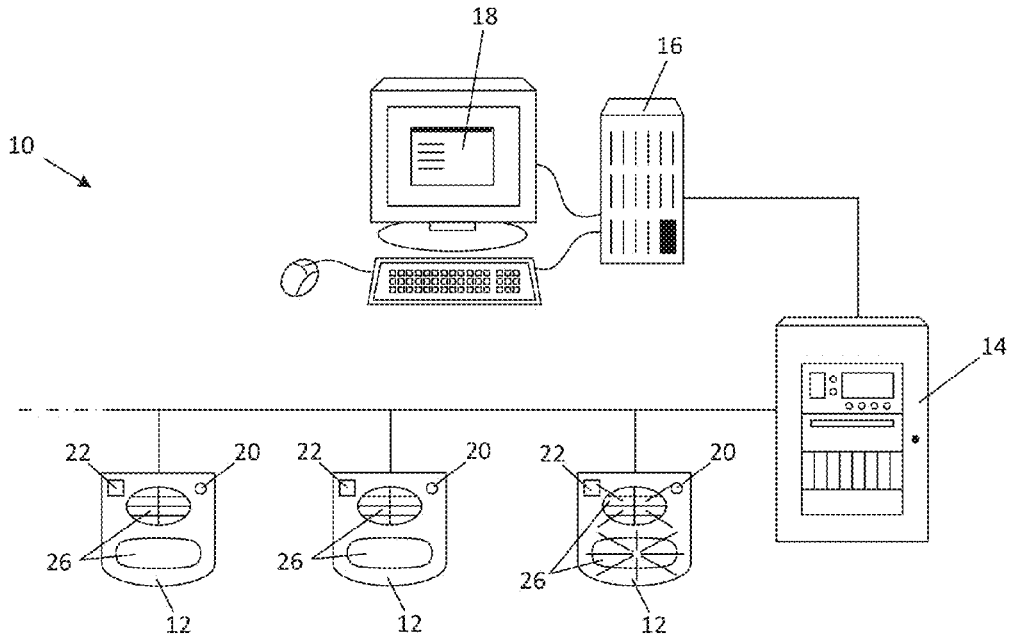
Figure 8:
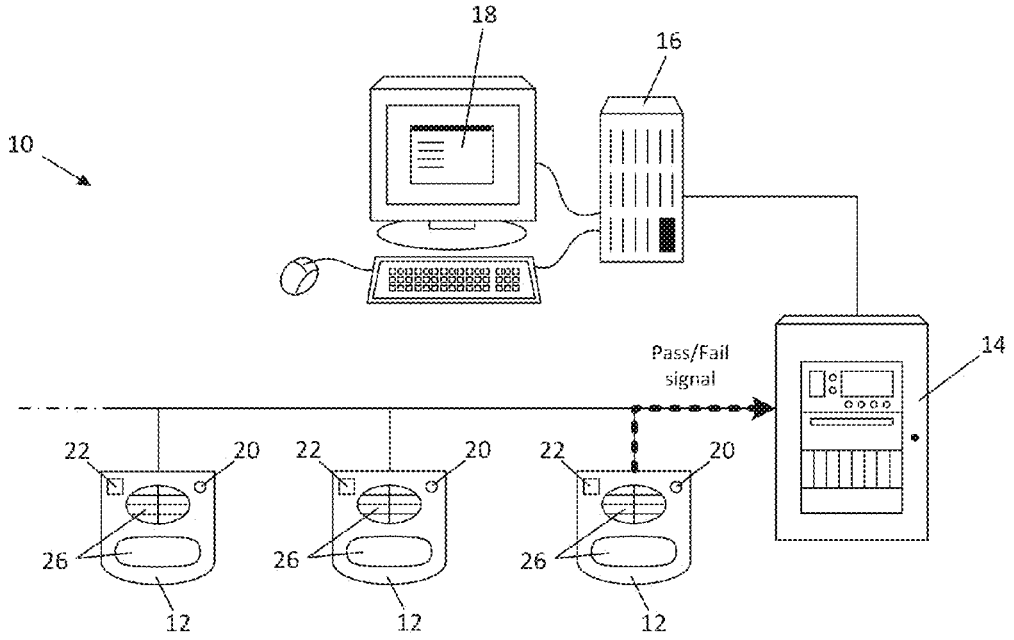

Alternatively, if it was determined in step 130 that the measured ambient noise did not exceed the threshold ambient noise level, the first notification appliance 12 may, at step 140*b* of the exemplary method, automatically initiate a self-test immediately after expiration of the ambient noise detection period. Particularly, the first notification appliance 12 may activate its notification features 26 for a predetermined amount of time as shown in FIG. 7, during which the sensor(s) 20 of the notification appliance 12 may measure the output of the notification features 26. The measured output may then be compared to predefined values to determine whether the notification appliance 12 is functioning properly. Such comparison may be performed by the notification appliance 12 itself, or by the alarm panel 14 or workstation 16, and the results (e.g., "pass" or "fail") of the self-test may be automatically transmitted to the alarm panel 14, as indicated by the dashed line shown in FIG. 8, and recorded thereby. By collecting pass/fail information in this manner, the alarm panel 14 may automatically create and store a self-test record for the notification appliance 12. Such a record may subsequently be reviewed by interested parties.

After the self-test of the first notification appliance 12 is completed, or if it was determined in step 130 that the notification appliance 12 "failed" due to excessive ambient noise, steps 120-140 described above may be repeated for each of the remaining notification appliances 12 in the alarm system 10 in a sequential manner as indicated at step 150 of the exemplary method. Particularly, each of the remaining notification appliances 12 may measure ambient noise, may compare the measured ambient noise to a threshold ambient noise level, and may perform a self-test if the ambient noise does not exceed the threshold ambient noise level. Sequential performance of steps 120-140 on each of the remaining notification appliances 12 may be performed automatically (e.g., as a result of signals automatically issued by the alarm panel 14) if automatic self-testing was selected by the technician in step 110, or may require the technician to physically visit and actuate the input device 22 of each remaining notification appliance 12 if manual self-testing was selected by the technician in step 110. Alternatively, it is contemplated that selecting automatic self-testing in step 110 may result in steps 120-140 being performed for all or some of the notification appliances 12 in the alarm system 10 substantially simultaneously (instead of sequentially). This may allow testing of the alarm system 10 to be completed more quickly than sequential performance of steps 120-140.

The method described herein thus provides improved means for self-testing notification appliances in an alarm system wherein such means are able to identify the presence of ambient sound or light and are further able to prevent such ambient sound or light from affecting the results of a self-test. This provides an advantage relative to existing self-test technologies, wherein the presence of ambient sound or light during the performance of a self-test may result in a false-positive.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A method for self-testing notification appliances in an alarm system, the method comprising:

measuring ambient noise at a notification appliance;

comparing the measured ambient noise to a threshold ambient noise level; and in response to the measured ambient noise not exceeding the threshold ambient noise level, performing a self-test comprising:

activating a notification feature of the notification appliance, measuring output of the notification feature;

comparing the measured output to a predefined value;

recording a pass result for the notification appliance if the measured output exceeds the predefined value; and recording a fail result for the notification appliance if the measured output does not exceed the predefined value in response to the measured ambient noise exceeding the threshold ambient noise level:

recording a special test fail result.

2. The method of claim 1, wherein the threshold ambient noise level represents a level of ambient noise that may be present during the performance of the self-test without affecting the result of the self-test.

3. The method of claim 1, wherein the threshold ambient noise level is in a range between 100 dB and 130 dB.

4. The method of claim 1, wherein the threshold ambient noise level is in a range between 8 candelas and 12 candelas.

5. The method of claim 1, wherein the step of measuring ambient noise is initiated at an alarm panel that is remote from the notification appliance.

6. The method of claim 1, wherein the step of measuring ambient noise is initiated by actuating an input device on the notification appliance.

7. The method of claim 6, wherein actuating the input device comprises disposing a magnet in close proximity to a magnetic switch in the notification appliance.

8. The method of claim 1, wherein the step of measuring ambient noise includes activating a sensor of the notification appliance for an ambient noise detection period.

9. The method of claim 8, wherein the ambient noise detection period has a duration in a range between 1 second and 5 seconds.

* * * * *